US007842138B2

(12) United States Patent
Pardini

(10) Patent No.: US 7,842,138 B2
(45) Date of Patent: Nov. 30, 2010

(54) ELASTIC OPPOSITION DEVICE FOR A DOOR OF A FRONT-LOADING DISHWASHING MACHINE, AND DISHWASHING MACHINE INCLUDING SUCH A DEVICE

(75) Inventor: Gianluca Pardini, Lucca (IT)

(73) Assignee: Premark FEG L.L.C., Wilmington, DE (US)

( * ) Notice: Subject to any disclaimer, the term of this patent is extended or adjusted under 35 U.S.C. 154(b) by 402 days.

(21) Appl. No.: 12/115,866

(22) Filed: May 6, 2008

(65) Prior Publication Data

US 2008/0276539 A1 Nov. 13, 2008

(30) Foreign Application Priority Data

May 7, 2007 (IT) ..... TO2007A0310

(51) Int. Cl.
*B08B 3/00* (2006.01)

(52) U.S. Cl. ..... 134/57 DL; 312/319.2; 292/229

(58) Field of Classification Search ..... 134/57 DL; 312/319.2; 292/229
See application file for complete search history.

(56) References Cited

U.S. PATENT DOCUMENTS 5,342,123 A * 8/1994 Cole et al. ..... 312/319.2

FOREIGN PATENT DOCUMENTS

| | | |
|---|---|---|
| CH | 683886 | 6/1994 |
| DE | 3616028 | 11/1987 |
| DE | 4412607 | 9/1994 |
| DE | 19923996 | 11/2000 |
| DE | 19958817 | 6/2001 |
| WO | 2006/117893 | 11/2006 |

OTHER PUBLICATIONS

European Search Report; Application EP-08155751; Aug. 13, 2008.
European Search Report, European Application No. 08155751.4 (Aug. 21, 2008).

* cited by examiner

*Primary Examiner*—Michael Cleveland
*Assistant Examiner*—Samuel A Waldbaum
(74) *Attorney, Agent, or Firm*—Thompson Hine LLP

(57) ABSTRACT

An opposition device for locking and/or braking a swing door of a dishwashing machine, in which the door is movable about a horizontal rotation axis and along a predetermined trajectory, between at least two opposite, respectively open and closed, limit positions. A contoured leaf spring is fitted integrally to a casing of the machine. The contoured leaf spring has a first and second flexible arm projecting forward. A substantially rigid arm is fixed for movement with the door, and projects inward from the door and towards the contoured leaf spring. The first and second flexible arm of the contoured leaf spring, and the rigid arm of the door cooperate, in use, in sliding contact with one another along at least part of the predetermined trajectory of the door, to oppose rotation of the door at least close to the two opposite limit positions.

22 Claims, 2 Drawing Sheets

ELASTIC OPPOSITION DEVICE FOR A DOOR OF A FRONT-LOADING DISHWASHING MACHINE, AND DISHWASHING MACHINE INCLUDING SUCH A DEVICE

The present application relates to an elastic opposition device for a door of an electric appliance, in particular a front-loading dishwashing machine, and to the electric household appliance equipped with such a device.

BACKGROUND

Dishwashing machines, particularly commercial types (for bars, restaurants, communities, etc.), normally comprise a front-loading wash tub closed in use by a swing door, e.g. rotating about a horizontal axis at the bottom edge of the door. The door therefore swings downwards and, in the fully open position, is substantially horizontal (or at most slightly tilted), so the inner face of the door also acts as a support for the dish-rack when this is extracted from the wash tub.

Doors of dishwashing machines of this type may be relatively heavy, and are opened frequently in use, either to load and unload the machine or check the dishes during the wash cycle, so the door is equipped with a counterbalancing device to at least partly counterbalance its weight and make it easier for the user to open and close. The machine must also be equipped with a pressure locking system to lock the door in the open and closed positions and preferably also in an intermediate, partly open position, to allow the steam to escape and to partly cool the dishes before they are unloaded.

CH-A-683886 describes a dishwashing machine in which the weight of the door is counterbalanced by a coil spring, which is stretched when the door is opened and so also assists the user in closing the door; and the door is locked, at least in the two limit positions, by a system of arms having limit stops and interconnected by a pin sliding inside a slot. The door can also be locked in the closed position by a pull-release spring lock.

Similar door braking and/or stop devices are also described in DE-A-19958817 and WO2006117893. In the latter, the coil spring operates together with a complex system of levers connected to an extremely bulky threaded rod housed partly inside the thickness of the door.

In other words, known dishwashing machine door counterbalancing devices are bulky, complicated, frequently unreliable (e.g. due to jamming of the levers), and do not always provide for locking the door in the closed position, so the machine must also be equipped with an additional locking device.

SUMMARY

It is an object of the present invention to eliminate the drawbacks of the known art by providing an elastic opposition device for a door of an electric appliance, in particular a front-loading dishwashing machine, which is reliable, compact, straightforward in design and relatively inexpensive, and which also provides for locking the door in the open and closed positions and preferably also in an intermediate, partly open position, with no additional devices, such as locks, stops, etc., required. It is also an object of the invention to provide a front-loading dishwashing machine featuring such a device, and in which the weight of the door is fully counterbalanced when opening and closing the door, regardless of whether or not conventional coil springs, stretched by opening the door, are employed.

According to the present invention, there is provided an opposition device for locking and/or braking a swing door of an electric appliance, in particular a front-loading dishwashing machine, and as claimed in the attached Claims.

The invention also relates to an electric household appliance featuring a door movable about a horizontal rotation axis and along a predetermined trajectory, between at least two opposite, respectively open and closed, limit positions, and as claimed in the attached Claims.

More specifically, the device according to the invention comprises: a contoured leaf spring fixable integrally to a casing of the appliance, in a fixed position close to the door rotation axis, and in turn comprising a first and second flexible arm projecting towards the door; and a substantially rigid arm fixed integrally to the door, in a fixed position close to the door rotation axis, and projecting from the door towards the contoured leaf spring. The first and second flexible arm of the contoured leaf spring, and the rigid arm of the door cooperate, in use, in sliding contact with one another along at least part of said predetermined trajectory of the door, so as to exert thrust on the door, at least close to the two opposite limit positions of the door, to oppose rotation of the door about its horizontal rotation axis.

The contoured leaf spring is substantially C-shaped in a plane crosswise to the door rotation axis, and comprises: a central fastening portion defined by a straight first portion of metal strip bent into an L at its opposite ends on the side of a first face eventually facing the door in use; and lateral portions defined by opposite, substantially straight second portions of metal strip constituting the first and second flexible arm, which project obliquely from the central portion in diverging directions from the L-shaped ends of the first portion of metal strip.

The substantially straight second portions of metal strip constituting the first and second flexible arm each have a free end opposite the central portion of the contoured leaf spring; and the free ends of the second portions of metal strip are bent into a V in a plane crosswise to the door rotation axis, and with their concavities facing the central portion of the contoured leaf spring, so as to define, on the first and second flexible arm and towards the rigid arm integral with the door, respective V-shaped projections with their apexes converging towards the rigid arm.

The opposite arms of the contoured leaf spring thus counterbalance the weight of the door—possibly together with a conventional extension spring stretched between the appliance casing and the rigid arm integral with the door. More specifically, they provide for braking over the final part of the predetermined trajectory into the fully open position, and, by virtue of the V-shaped projections and together with the rigid arm integral with the door, selectively define three different flexible lock positions of the door: in the open position, in the closed position, and in an intermediate partly open position close to the closed position, to allow the steam to escape and cool the dishes.

Preferably, the contoured leaf spring is designed to fit inside a cavity formed in the appliance casing, at the door rotation axis; and the first and second flexible arm of the contoured leaf spring, and the rigid arm integral with the door, project inside the cavity to further reduce (practically render negligible) the encumberment of the device as a whole.

BRIEF DESCRIPTION OF THE DRAWINGS

A non-limiting embodiment of the invention will be described by way of example with reference to the accompanying drawings, in which.

DETAILED DESCRIPTION

Figure 1:
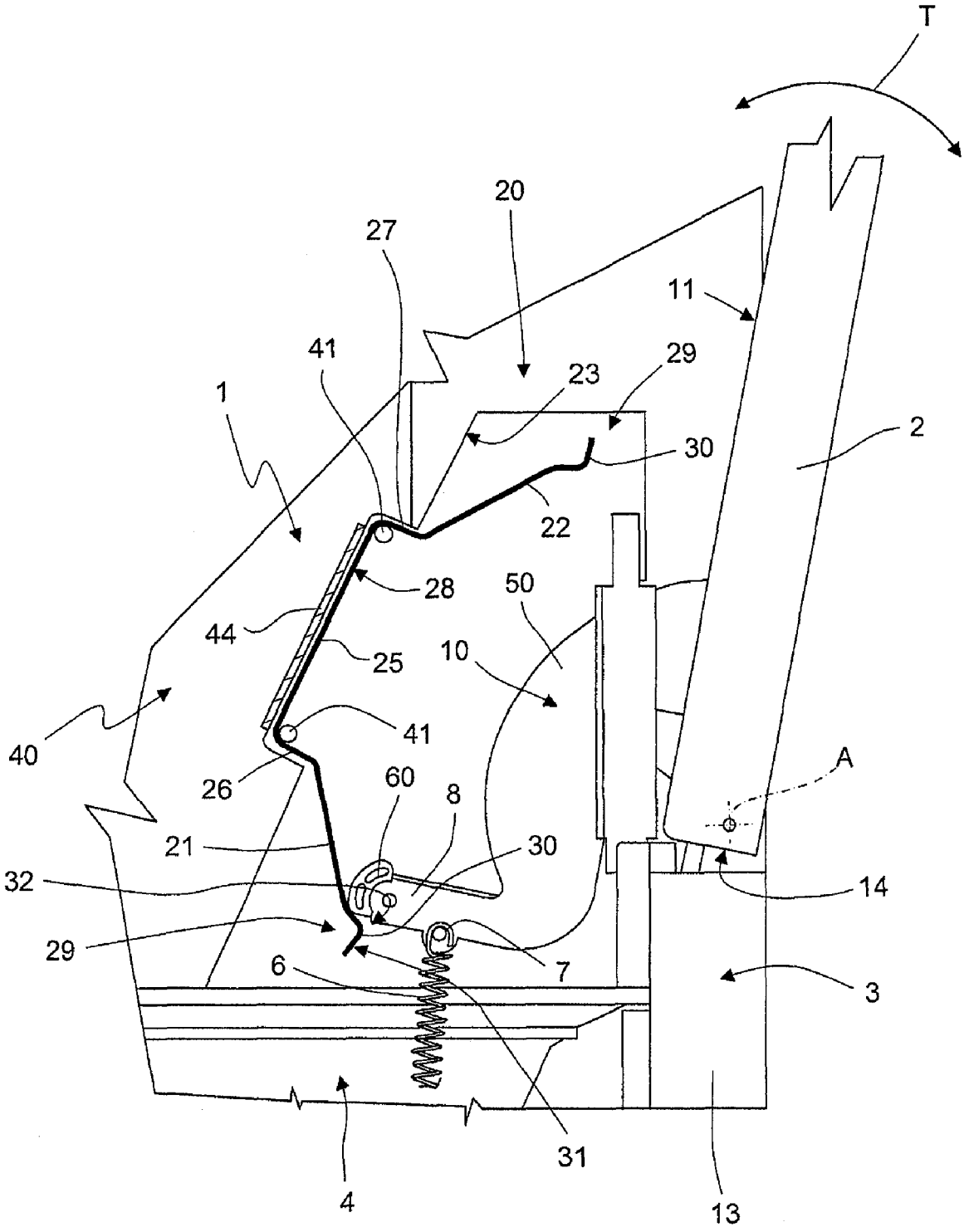
FIG. 1 shows a schematic side view and longitudinal section of an electric household appliance featuring a swing door rotating about a horizontal axis, the appliance being equipped with an elastic device for opposing rotation of the door in accordance with the invention, and shown with the door in an intermediate partly open position.
Figure 2:
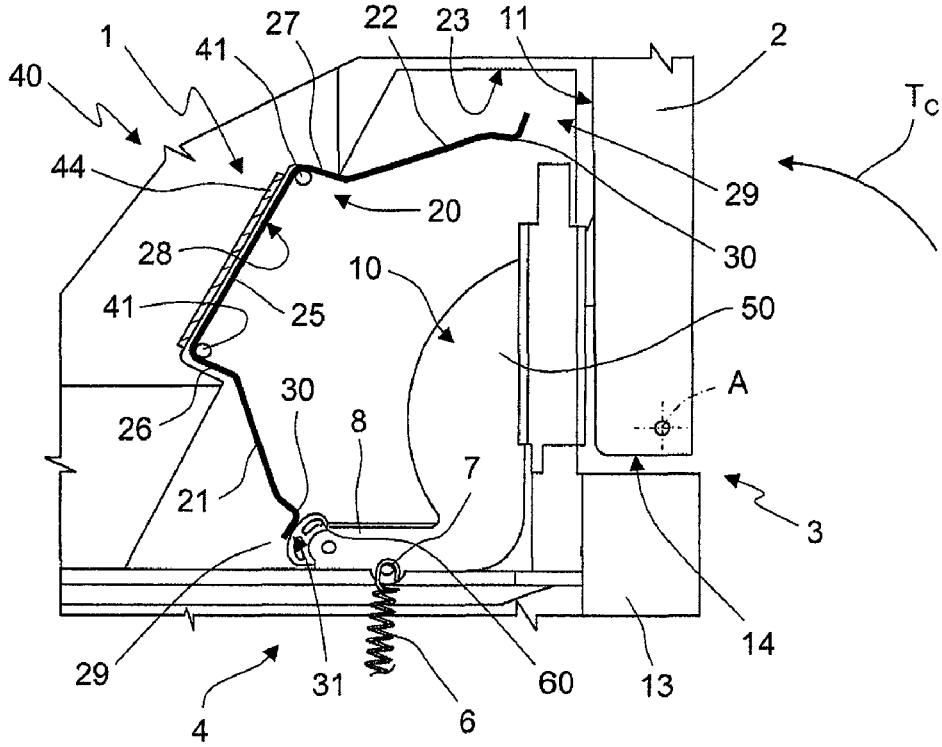
FIGS. 2 and 3 show smaller-scale views, as in FIG. 1, with the door and the opposition device in two different limit positions.
Figure 3:
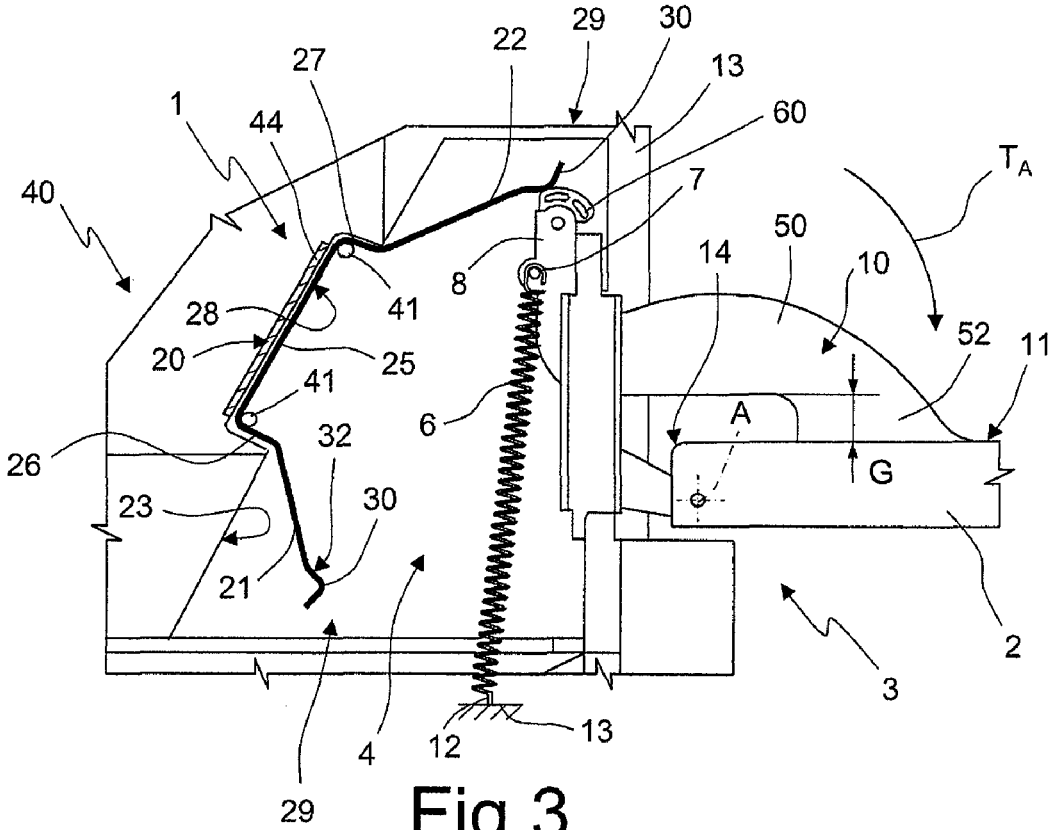

Number 1 in FIGS. 1 to 3 indicates as a whole an opposition device for locking and/or braking a swing door 2 of an electric household appliance 3, in particular a front-loading dishwashing machine, which dishwashing machine may include one or more internal dish racks (not shown) and/or one or more internal spray nozzles (not shown). The dish rack(s) may be moveable in and out of the front opening of the machine for dish loading/unloading and the nozzle(s) may be located in one or more arms that rotate within the machine during cleaning operations.

The door 2 rotates, about a horizontal rotation axis A (defined in known manner, for example, by idle pins) and along a predetermined substantially circular trajectory T with its centre of rotation at axis A, between at least two opposite, respectively open and closed, limit positions shown in FIGS. 3 and 2 respectively.

Device 1 comprises elastic means 4 to at least partly counterbalance the weight of door 2 over at least part, and preferably over the whole, of predetermined trajectory T between the FIGS. 2 and 3 positions.

In the non-limiting example in FIGS. 1 to 3, elastic means 4 comprise a conventional extension spring 6 connected at a first end 7 to the centre-line of a first leg 8 of a substantially rigid, L-shaped arm 10 integral with door 2 and projecting inwards of the appliance from an inner face 11 of door 2. A second end 12 (FIG. 3), opposite end 7, of spring 6 is connected in known manner to a casing 13 (e.g., housing and/or frame) of appliance 3, which casing 13 is also fitted with door 2, substantially along a bottom transverse edge 14 of door 2 rotating about axis A. Spring 6—which is fitted, already pretensioned, between casing 13 and arm 10 when door 2 is in the fully closed position in FIG. 2—is therefore stretched during rotation of door 2 into the fully open position in FIG. 3 (trajectory $T_A$) to counterbalance the weight of door 2 in substantially known manner, and, when the door rotates in the opposite direction along trajectory $T_C$ (FIG. 2), also assists the user in closing door 2, by again counterbalancing the weight, or at least most of the weight, of the door.

According to a first aspect, elastic means 4 comprise—either in conjunction with spring 6, as in the preferred non-limiting embodiment shown, or instead of spring 6—a contoured leaf spring 20 fixable, as will be explained, integrally with casing 13 of appliance 3, in a fixed position close to door rotation axis A, and in turn comprising a first and second flexible arm 21, 22 projecting towards door 2 and towards a front of the machine.

Device 1 also comprises the substantially rigid, L-shaped arm 10 ("substantially rigid" being intended to mean by comparison with flexible arms 21, 22) fixed integrally to door 2, e.g. formed in one piece with inner face 11 of the door, in a fixed position close to door rotation axis A. Arm 10 projects from door 2 towards contoured leaf spring 20, and, according to the invention, is provided even if spring 6 is eliminated.

Flexible arms 21 and 22 of contoured leaf spring 20, and rigid arm 10 of door 2 cooperate, in use, in sliding contact with one another along at least part of the predetermined trajectory T of door 2, so as to exert—by elastic reaction and as explained below—thrust on door 2, at least close to the two opposite limit positions of the door in FIGS. 2 and 3, to oppose rotation of door 2 about horizontal axis A.

Contoured leaf spring 20 is preferably designed to fit inside a cavity 23 formed in casing 13 of appliance 3, at or near door rotation axis A (e.g., in the lower front corner of the machine), and actually within and on one side of the wash tub or space defined in appliance 3 and closed, in use, by door 2. Flexible arms 21, 22 of contoured leaf spring 20, and rigid arm 10, integral with door 2, are so positioned as to project inside cavity 23; and spring 6, if provided, is also located inside cavity 23, so the whole of device 1 is housed inside cavity 23 and avoids interfering with either the wash tub of appliance 3, or the loading/unloading opening bounded and closed by door 2.

In one implementation, contoured leaf spring 20 is substantially C-shaped in a plane crosswise to door rotation axis A—in the example shown, the FIG. 1-3 plane—and, in the example shown, is made by cutting and bending a length of metal strip of music wire steel, and comprises a central fastening portion 25 defined by a straight first portion of the metal strip bent into an L at its opposite ends 26, 27 and on the side of a first face 28 eventually facing door 2 in use.

Contoured leaf spring 20 also comprises lateral portions defined by opposite, substantially straight second portions of the metal strip constituting first and second flexible arm 21, 22, which project obliquely from central portion 25 in diverging directions from L-shaped ends 26, 27 of the first portion of metal strip defining central portion 25.

Along the whole of predetermined trajectory T of door 2 between the two limit positions shown in FIGS. 2 and 3, rigid arm 10 is designed to move inside the space defined between central portion 25 and the lateral portions of contoured leaf spring 20 defining arms 21 and 22.

The substantially straight second portions of metal strip constituting first and second flexible arm 21, 22 each have a free end 29 opposite central portion 25 of contoured leaf spring 20, and more specifically opposite the L-shaped ends 26, 27 from which flexible arms 21, 22 extend; and the free ends 29 are bent into a V in said plane crosswise to door rotation axis A, and with their concavities facing central portion 25 of contoured leaf spring 20, so as to define, on first and second flexible arm 21, 22 and towards rigid arm 10 integral with door 2, respective V-shaped projections 30 lying in the plane crosswise to axis A, and with their respective apexes converging towards rigid arm 10.

As a result, and by appropriately designing and locating arms 21, 22 and 10 on casing 13 and door 2 respectively, arms 10, 21, 22 operate in conjunction with one another, so that, when door 2 is in the FIG. 2 closed position, rigid arm 10 cooperates interferentially with an outer side 31 of the V-shaped projection 30 of flexible arm 21, preferably facing downwards, to lock door 2 in the closed position. As used in connection with the operation of the contoured leaf spring the use of the phrase "lock the door" or "lock door" in any given position is intended to refer to the operation of applying a holding force against movement of the door out of the given position so as to prevent movement of the door out of the given position unless the force that is exerted on the door is sufficient to overcome the holding force exerted by interaction of the contoured leaf spring and the rigid arm of the door.

Similarly, when door 2 is in the FIG. 3 fully open position, rigid arm 10 cooperates interferentially with V-shaped projection 30 of flexible arm 22, preferably facing upwards, to lock door 2 in the open position.

Also, when door 2, moving along open trajectory $T_A$ or close trajectory $T_C$, nears the closed position, rigid arm 10 cooperates interferentially with the bottom of an inner side 32 of V-shaped projection 30 of flexible arm 21, so that the weight of door 2 partly flexes flexible arm 21, the elastic reaction of which on rigid arm 10 holds door 2 locked in the intermediate, partly open position shown in FIG. 1.

Similarly, close to the fully open position in FIG. 3, rigid arm 10, before reaching end 29 and relative projection 30, cooperates interferentially with the as yet undeformed flexible arm 22 to flex arm 22, which exerts on rigid arm 10 an elastic reaction that increases gradually the closer door 2 gets to the open position, to gradually brake door 2 along at least the final portion of open trajectory $T_A$. If spring 6, which alone counterbalances most of the weight of door 2, is also provided, arm 22 at this stage provides for purely dynamic braking of door 2.

Conversely, by appropriately designing contoured leaf spring 20, flexible arm 22, in addition to braking door 2, may obviously be flexed further to also counterbalance the weight of door 2, at least along the final portion of trajectory $T_A$, so spring 6 can be eliminated.

To ensure correct location and operation of contoured leaf spring 20, device 1 according to the invention also comprises fastening means 40 for securing contoured leaf spring 20 to casing 13 of appliance 3, and which are shown more clearly in the larger-scale FIG. 1.

More specifically, fastening means 40 comprise pins 41 integral with casing 13, formed in a recess of cavity 23 in the example shown, and between which central portion 25 of contoured leaf spring 20 is fitted, with each of its opposite L-shaped ends 26, 27 fitted at least 90° about a respective pin 41. Contoured leaf spring 20 is assembled so that central portion 25 is preferably preloaded, e.g. by making portion 25 slightly shorter than the distance between the axes of pins 41.

Fastening means 40 preferably also comprise a supporting member 44 (hatched in the drawings) formed integrally with pins 41, and which supports central portion 25 of contoured leaf spring 20, on the opposite side to pins 41, so that portion 25 of spring 20 is gripped between pins 41 and supporting member 44, which is defined, for example, by an appropriately shaped wall portion of cavity 23.

As stated, rigid arm 10 integral with door 2 is L-shaped in the plane crosswise to door rotation axis A; and, as opposed to directly contacting inner face 11 of door 2, a leg 50 of arm 10, opposite and perpendicular to leg 8, is preferably detached from inner face 11 by a predetermined clearance G (FIG. 3) extending in the same direction as leg 8, by fixing leg 50 to door 2, for example, by a base portion 52 (FIG. 3) perpendicular to the longitudinal extension direction of leg 50 and parallel to, but on the opposite side to, leg 8.

The free end of leg 8 of L-shaped rigid arm 10 is fitted integrally with a cam 60 made, for example, of low-friction plastic material applied, e.g. molded onto, the free end of leg 8, and which is convex in shape to slide, in use, on a face of flexible arms 21, 22 and relative projections 30 facing the same way as face 28.

Contoured leaf spring 20 is preferably symmetrical, with identical first and second arms 21, 22, to reduce the cost, and safeguard against improper assembly, of spring 20. If necessary, however, contoured leaf spring 20 may obviously be asymmetrical, e.g. with arms 21, 22 of different lengths and/or shapes.

Device 1 described may be produced in kit form and fitted to appliance 3 at the assembly stage, or may be formed integrally with appliance 3, e.g. by forming arm 10 integrally in one piece with door 2. Whichever the case, device 1 provides for obtaining an electric appliance—in particular, a front-loading dishwashing machine in the example described—featuring a door 2 movable, about a horizontal rotation axis A and along a predetermined trajectory T, between at least two opposite, respectively open and closed, limit positions as shown in FIGS. 3 and 2, and wherein rotation of the door along trajectory T is opposed, as desired or necessary, by device 1.

This provides for braking door 2, in opposition to its own weight, along at least the final part of trajectory T close to the open position, as well as for locking door 2 releasably (by pressing or pulling the door by hand) in a number of predetermined positions, i.e. elastically locking door 2 (i.e. by interference with flexible arms 21, 22) in the open, closed, and intermediate, partly open positions. All of which, moreover, is achieved, in accordance with the aims of the present invention, by means of a device which is compact, straightforward, inexpensive to produce, and highly reliable (preferably with no connections subject to jamming).

The invention claimed is:

1. An opposition device for locking and/or braking a swing door of an electric appliance in which the door is movable about a horizontal rotation axis and along a predetermined trajectory, between at least two opposite, respectively open and closed, limit positions; the device comprising elastic means for at least partly counterbalancing the weight of the door along at least part of said predetermined trajectory, and being characterized by comprising:

a contoured leaf spring fixable integrally to a casing of the appliance, in a fixed position close to the rotation axis of the door, the contoured leaf spring in turn comprising a first flexible arm projecting towards the door, and a second flexible arm projecting towards the door;

a substantially rigid arm fixed integrally to the door, in a fixed position close to the rotation axis of the door, and projecting from the door towards the contoured leaf spring;

said first flexible arm and second flexible arm of the contoured leaf spring, and said rigid arm of the door cooperating, in use, in sliding contact with one another along at least part of said predetermined trajectory of the door, so as to exert thrust on the door, at least close to said two opposite limit positions of the door, to oppose rotation of said door about said rotation axis.

2. A device as claimed in claim 1, characterized in that said contoured leaf spring is designed to fit inside a cavity formed in the casing of the appliance, at said rotation axis of the door; said first flexible arm and said second flexible arm projecting, in use, inside said cavity, and said rigid arm projecting, in use, inside said cavity.

3. A device as claimed in claim 1, characterized in that said contoured leaf spring is substantially C-shaped in a plane crosswise to said rotation axis of the door; said contoured leaf spring comprising: a central fastening portion defined by a straight first portion of metal strip bent into an L at its opposite ends, on the side of a first face eventually facing the door in use; and lateral portions defined by opposite, substantially straight second portions of metal strip respectively constituting said first flexible arm and said second flexible arm, which each project obliquely from the central portion in diverging directions from the L-shaped ends of the first portion of metal strip.

4. A device as claimed in claim 3, characterized in that, along the whole of said predetermined trajectory of the door between said two limit positions, said rigid arm is designed to move, in use, within a space defined between said central portion and said lateral portions of the contoured leaf spring.

5. A device as claimed in claim 3, characterized in that said substantially straight second portions of metal strip constituting said first flexible arm and said second flexible arm each have a respective free end opposite said central portion of the contoured leaf spring; said free ends of said second portions of metal strip being bent into a V in said plane crosswise to the rotation axis of the door, and with their concavities facing the central portion of the contoured leaf spring, so as to define, on the first flexible arm and the second flexible arm and towards the rigid arm integral with the door, respective V-shaped projections with their apexes converging towards the rigid arm.

6. A device as claimed in claim 5, characterized in that said first flexible arm and said second flexible arm and said rigid arm operate in conjunction with one another, so that, when the door is in the closed position, the rigid arm integral with door cooperates with an outer side of the V-shaped projection of the first flexible arm, preferably facing downwards, to lock the door in the closed position; and, when the door is in the open position, the rigid arm integral with the door cooperates with the V-shaped projection of the second flexible arm, preferably facing upwards, to lock the door in the open position.

7. A device as claimed in claim 6, characterized in that, close to the closed position, the rigid arm integral with the door cooperates with the bottom of an inner side of the V-shaped projection of the first flexible arm, so that the weight of the door partly flexes the first flexible arm, the elastic reaction of which on the rigid arm holds the door locked in an intermediate, partly open position; and in that, close to the open position, the rigid arm integral with the door cooperates with said second flexible arm to flex the second flexible arm, which exerts on the rigid arm an elastic reaction that increases gradually the closer the door gets to the open position, to gradually brake the door.

8. A device as claimed in claim 3, characterized by comprising fastening means for securing the contoured leaf spring to the casing of the appliance, and which comprise first and second spaced apart pins integral with said casing and between which the central portion of said contoured leaf spring is fitted, with each of its opposite L-shaped ends fitted about a respective one of said first and second pins.

9. A device as claimed in claim 8, characterized in that the fastening means also comprise a supporting member integral with said pins, and which supports said central portion of the contoured leaf spring, so that said central portion is gripped between said pins and said supporting member.

10. A device as claimed in claim 1, characterized in that said rigid arm integral with the door is L-shaped in the plane crosswise to the rotation axis of the door.

11. A device as claimed in claim 10, characterized in that a free end of a first leg of said L-shaped rigid arm is fitted integrally with a sliding cam which slides, in use, on said flexible arms.

12. A device as claimed in claim 1, characterized in that the counterbalancing is provided in part by said elastic means comprising said contoured leaf spring (20) and in part by a coil spring connected at a first end to the centre-line of the first leg of the L-shaped rigid arm, and, at a second end opposite the first, to the casing of the appliance.

13. A device as claimed in claim 1, characterized in that said contoured leaf spring is symmetrical, with identical first and second flexible arms.

14. An electric a front-loading dishwashing machine, having a door movable, about a horizontal rotation axis and along a predetermined trajectory, between at least two opposite, respectively open and closed, limit positions; and having an opposition device, as claimed in claim 1, for locking and/or braking the door, which is mounted so that the door is locked elastically in the open and closed positions and in an intermediate, partly open position, and is braked, in opposition to its own weight, along at least a final part of said predetermined trajectory, close to the open position.

15. An electric appliance, comprising:

a casing defining an internal space accessible by a front opening;

a swing door movable relative to the front opening about a horizontal rotation axis, between at least two opposite, respectively open and closed, limit positions;

a first flexible arm projecting towards the front of the appliance and a second flexible arm projecting towards the front of the appliance;

a substantially rigid arm fixed for movement with the door and projecting inward from the door;

said first flexible arm and said rigid arm cooperating, in use, in sliding contact with each other when the door is in the closed position so as to exert a holding force on the door;

said second flexible arm and said rigid arm cooperating, in use, in sliding contact with each other when the door is in the open position so as to exert a holding force on the door.

16. The appliance of claim 15 wherein the first flexible arm and the second flexible arm are formed as opposite end portions of a contoured leaf spring.

17. The appliance of claim 16 wherein the contoured leaf spring is located within a cavity formed in a front lower corner of the appliance, said first flexible arm and said second flexible arm projecting, in use, inside said cavity, and said rigid arm projecting, in use, inside said cavity.

18. The appliance of claim 16 wherein the contoured leaf spring is substantially C-shaped in a plane crosswise to said rotation axis of the door, said contoured leaf spring including single metal strip having a central portion defined by a straight portion with bent opposite ends, a first lateral portion forming the first flexible arm and a second lateral portion forming the second flexible arm, the first flexible arm and the second flexible arm projecting obliquely from the bent opposite ends of the central portion.

19. The appliance of claim 18 wherein first and second spaced apart pins are provided on the casing, the central portion of the contoured leaf spring extends between the first and second spaced apart pins, with each of its opposite bent ends fitted about a respective one of the first and second pins.

20. The appliance of claim 19 wherein a supporting member is located on the casing and supports the central portion of the contoured leaf spring, so that the central portion is gripped between the first and second pins and the supporting member.

21. The appliance of claim 15 wherein a free end of the rigid arm is fitted with a sliding cam which slides, in use, on the first flexible arm and the second flexible arm.

22. The appliance of claim 15 wherein the appliance is a dishwashing machine including a plurality of internal spray nozzles for ejecting liquid in the internal space during dish cleaning operations.

* * * * *